US012343790B2

(12) United States Patent
Osmont et al.

(10) Patent No.: US 12,343,790 B2
(45) Date of Patent: Jul. 1, 2025

(54) ASSEMBLY FOR PRODUCING A MOLDING MADE OF REMOVABLE MATERIAL OF A TURBOMACHINE

(71) Applicants: SAFRAN, Paris (FR); SAFRAN AIRCRAFT ENGINES, Paris (FR)

(72) Inventors: Hervé Bruno Marc Osmont, Moissy-Cramayel (FR); Ramzi Bohli, Moissy-Cramayel (FR); Alexis Lourette, Moissy-Cramayel (FR); Joseph Toussaint Tami Lizuzu, Moissy-Cramayel (FR)

(73) Assignees: SAFRAN, Paris (FR); SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 18/728,789

(22) PCT Filed: Jan. 13, 2023

(86) PCT No.: PCT/FR2023/050048
§ 371 (c)(1),
(2) Date: Jul. 12, 2024

(87) PCT Pub. No.: WO2023/135395
PCT Pub. Date: Jul. 20, 2023

(65) Prior Publication Data

US 2025/0083221 A1 Mar. 13, 2025

(30) Foreign Application Priority Data

Jan. 13, 2022 (FR) ..... 2200251

(51) Int. Cl.
*B22D 17/24* (2006.01)
*B22D 25/02* (2006.01)

(52) U.S. Cl.
CPC ..... *B22D 17/24* (2013.01); *B22D 25/02* (2013.01)

(58) Field of Classification Search
CPC ..... B22D 17/24; B22D 25/02; B22C 9/10; B22C 9/103
See application file for complete search history.

(56) References Cited

U.S. PATENT DOCUMENTS

| | | | |
|---|---|---|---|
| 4,283,835 | A | 8/1981 | Obrochta et al. |
| 4,289,191 | A | 9/1981 | Myllymaki |

FOREIGN PATENT DOCUMENTS

| | | | |
|---|---|---|---|
| CN | 212822530 | U | 3/2021 |
| FR | 2 874 186 | A1 | 2/2006 |
| FR | 2 875 425 | A1 | 3/2006 |

OTHER PUBLICATIONS

International Search Report mailed Apr. 3, 2023, issued in corresponding International Application No. PCT/FR2023/050048, filed Jan. 13, 2023, 5 pages.

(Continued)

*Primary Examiner* — Kevin P Kerns
*Assistant Examiner* — Steven S Ha
(74) *Attorney, Agent, or Firm* — CHRISTENSEN O'CONNOR JOHNSON KINDNESS PLLC

(57) ABSTRACT

An assembly for producing a molding, made of removable material, of a turbomachine blade, includes an injection mold for the removable material in which a first core element and a second core element are mounted in a predetermined molding position, wherein the first and second core elements extend in a first direction. The mold includes a first face for molding a pressure-side face of the blade and a second face for molding a suction-side face of the blade and arranged facing the first face in a second direction perpendicular to the first direction.

(Continued)

Retaining members hold the cores in position in the injection mold.

10 Claims, 8 Drawing Sheets

(56) References Cited

OTHER PUBLICATIONS

Written Opinion mailed Apr. 3, 2023, issued in corresponding International Application No. PCT/FR2023/050048, filed Jan. 13, 2023, 6 pages.

ASSEMBLY FOR PRODUCING A MOLDING MADE OF REMOVABLE MATERIAL OF A TURBOMACHINE

FIELD OF THE DISCLOSURE

This disclosure relates to the field of turbomachine blades, in particular blades obtained by casting a molten alloy in a mold using a casting technique where material is removed, such as the lost wax casting technique for example.

BACKGROUND

Conventionally, the lost wax casting technique firstly consists of making a model out of wax or any other material that can subsequently be easily removed, of the part to be produced; this model comprises an internal part forming a ceramic core which represents the cavities that we wish to see created inside the blade. The wax model is then dipped several times in slurries composed of a suspension of ceramic particles in order to make a shell mold, through operations called stuccoing and drying.

The shell mold is then dewaxed, which is an operation through which the wax or material constituting the original model is removed from the shell. After this removal, a ceramic mold is obtained in which the cavity reproduces all the shapes of the blade and which still contains the ceramic core intended to generate the internal cavities. The mold then undergoes heat treatment at high temperature, or "firing", which gives it the necessary mechanical properties.

The shell mold is then ready for manufacturing the metal part by casting. After verifying the internal and external integrity of the shell mold, the next step consists of pouring a molten metal into it, which fills the voids between the interior wall of the shell mold and the core, then solidifying the metal. In the field of lost wax casting, there are currently several solidification techniques and several casting techniques, depending on the nature of the alloy and the expected properties of the part that results from the casting. These may be directional solidification with columnar structure (DS), directional solidification with single crystal structure (SX), or equiaxed solidification (EX).

After the alloy is cast, the shell is broken off by a shaking operation. During another step, the ceramic core which remains enclosed in the obtained blade is removed chemically. The obtained metal blade then undergoes finishing operations which allow obtaining the finished part.

Examples of producing turbine blades using the lost wax casting technique are given in patent applications FR2875425 and FR2874186 of the applicant.

To form the wax model of the blade a wax injection mold or similar equipment is used, into which the core is placed, and then the liquid wax is injected through a channel provided for this purpose.

The search for increased engine performance implies a more efficient cooling of the turbine blades located immediately downstream of the combustion chamber. This requirement necessitates the formation of more elaborate internal cavities for the circulation of cooling fluid inside these blades. These blades have the distinctive characteristic of having several metal walls and therefore require the manufacture of increasingly complex ceramic cores.

Due to the complexity of the cooling cavities to be formed with their separating walls, and of their arrangement, one solution consists of producing the core in several parts which are assembled and glued together. The core parts are generally connected together at the foot and at the top. This is in fact about controlling the thickness of the walls and partitions formed at the time of casting, without affecting the geometry of the future cavities. The assembly must allow the core to withstand the stresses undergone during the steps of wax injection, dewaxing, and then casting.

It is therefore necessary to position the different core parts very precisely relative to each other in the wax injection mold and to ensure that the relative positions of the different core parts are maintained. Maintaining the different core parts as proposed in the current technique consists of fixedly connecting these core parts or elements to the ceramic shell.

In a context of designing a new blade having complex cavities, the retained solution consists of producing the core in two parts, in particular because of the complexity of the cavities forming the cooling circuit and the difficulties encountered in demolding the core from its injection mold. However, due to the too-small dimensions of the core parts and their complex geometry, it is impossible to connect these core parts together, for example by gluing, so that the core with its assembled parts can then be positioned in a wax injection mold system comprising a conventional isostatic positioning system with six support points.

The difficulty encountered is twofold, because on the one hand it requires very precisely positioning the different core parts in the wax injection mold and on the other hand positioning the different core parts relative to each other. Indeed, the two parts cannot each comprise their own conventional isostatic positioning system with six support points relative to the mold, because this would double the number of supports to be integrated into the wax injection mold, which is not possible in terms of the mold dimensions. In addition, as the two core parts are intertwined at some locations, certain points of isostatism cannot be placed within the wax injection mold. Therefore, simple positioning of the cores relative to the mold cannot enable a complete positioning of the cores relative to each other.

It is therefore understood that it is desirable to implement a different attachment of the cores to each other in the wax injection mold.

The disclosure aims in particular to provide a simple, effective and economical solution to the problems of the prior art described above.

SUMMARY

For this purpose, the present disclosure proposes an assembly for producing a molding, made of removable material, of a turbomachine blade, comprising an injection mold for the removable material in which a first core element and a second core element are able to be mounted in a predetermined molding position, the first and second core elements extending in a first direction, the mold comprising:

- a first molding face for molding a pressure-side face of the blade and a second molding face for molding a suction-side face of the blade and arranged facing the first face in a second direction perpendicular to the first direction,
- retaining members for holding the cores in position in the injection mold, at least a first retaining member extending from the first face of the mold in the second direction and extending at least partially through the first and second core elements, the first retaining member comprising a first support point at which it bears against the first core element and a second support point at which it bears against the second core element.

Additionally or alternatively, the assembly may comprise the following features, taken alone or in combination:

the first core element and the second core element are shaped so that the first support point of the first retaining member blocks movement of the first core element in a first directional orientation along a third direction perpendicular to the first and second directions and the second support point of the first retaining member blocks movement of the second core element in a second directional orientation that is opposite to the first directional orientation along the third direction;

a second retaining member extends from the first molding face in the second direction, the second retaining member comprising a first support point at which it bears against the first core element and a second support point at which it bears against the second core element, the first support point and second support point of the second retaining member being different from the first support point and second support point of the first retaining member;

the first core element and the second core element are shaped so that the first support point of the second retaining member blocks movement of the first core element in the first directional orientation along a third direction perpendicular to the first and second directions and the second support point of the second retaining member blocks movement of the second core element in a second directional orientation that is opposite to the first directional orientation along the third direction;

the second retaining member comprises a spacing means between the first support point of the second retaining member and the second support point of the second retaining member, the spacing means ensuring, during production of the molding made of removable material, a spacing of constant distance between the support points along the third direction;

the first retaining member comprises a spacing means between the first support point of the first retaining member and the second support point of the first retaining member, the spacing means ensuring, during production of the molding made of removable material, a spacing of constant distance between the support points along at least one among the first direction, the second direction, or the third direction;

the first retaining member and/or the second retaining member is movable between a retaining position for holding at least one core element and a retracted position, the retaining member comprising a retraction mechanism for positioning the retaining member in the retaining position or in the retracted position;

the first retaining member and/or the second retaining member comprises an axis of rotation and a head that is eccentric relative to the axis of rotation and that cooperates with the first core element and the second core element.

According to another aspect, a method is proposed for producing a molding, made of removable material, of a turbomachine blade, the method comprising:

providing a first core element and a second core element, the core elements extending in a first direction, providing an injection mold for the removable material; the mold comprising:

a first molding face for molding a pressure-side face of the blade and a second molding face for molding a suction-side face of the blade and arranged facing the first face in a second direction perpendicular to the first direction, retaining members for holding the cores in position in the injection mold, among which at least a first retaining member extends from the first molding face in the second direction, the method comprising the step of: positioning the first core element and the second core element on the first molding face such that the first retaining member extends at least partially through the first and second core elements and comprises a first support point at which it bears against the first core element and a second support point at which it bears against the second core element.

The method may further comprise the step of: positioning the first core element and the second core element on the first molding face such that the second retaining member comprises a first support point at which it bears against the first core element and a second support point at which it bears against the second core element, the mold further comprising a second retaining member extending from the first molding face in the second direction.

DESCRIPTION OF THE DRAWINGS

Other features, details and advantages will become apparent upon reading the detailed description below, and upon analyzing the attached drawings, in which.

DETAILED DESCRIPTION

The terms "upstream" and "downstream" used below are defined in relation to the direction of flow of gases through a turbomachine, indicated by arrow F in FIG. 1.

Figure 1:
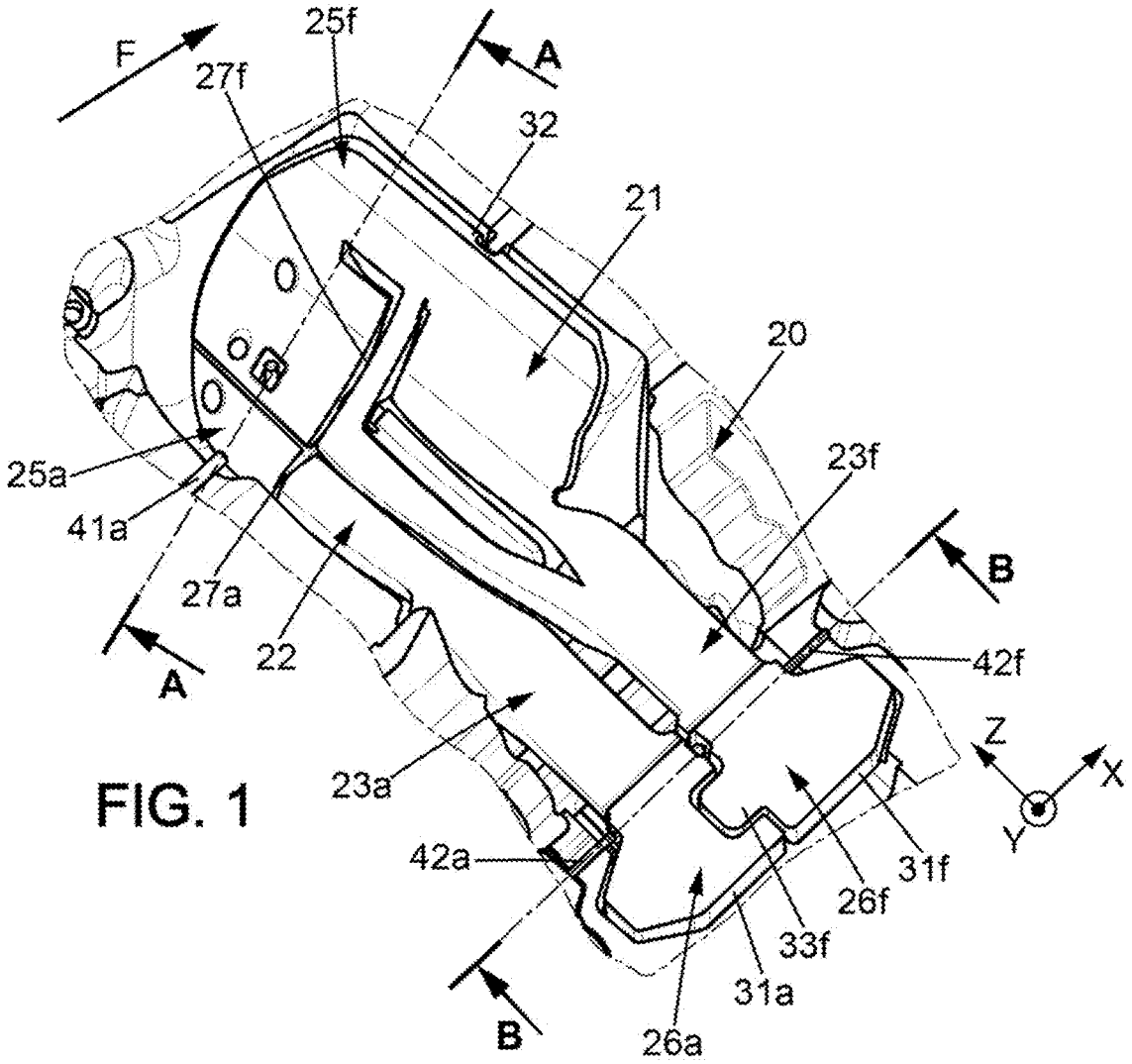
FIG. 1 shows a perspective view of a first and second core element placed on a first face of an injection mold for a removable material.

FIG. 1 illustrates the arrangement of the core elements in an injection mold, only a first molding face 20 being illustrated. FIG. 1 illustrates that the core is in the form of a first core element and a second core element, hereinafter referred to as the leading core element 22 and the trailing core element 21.

Figure 3:
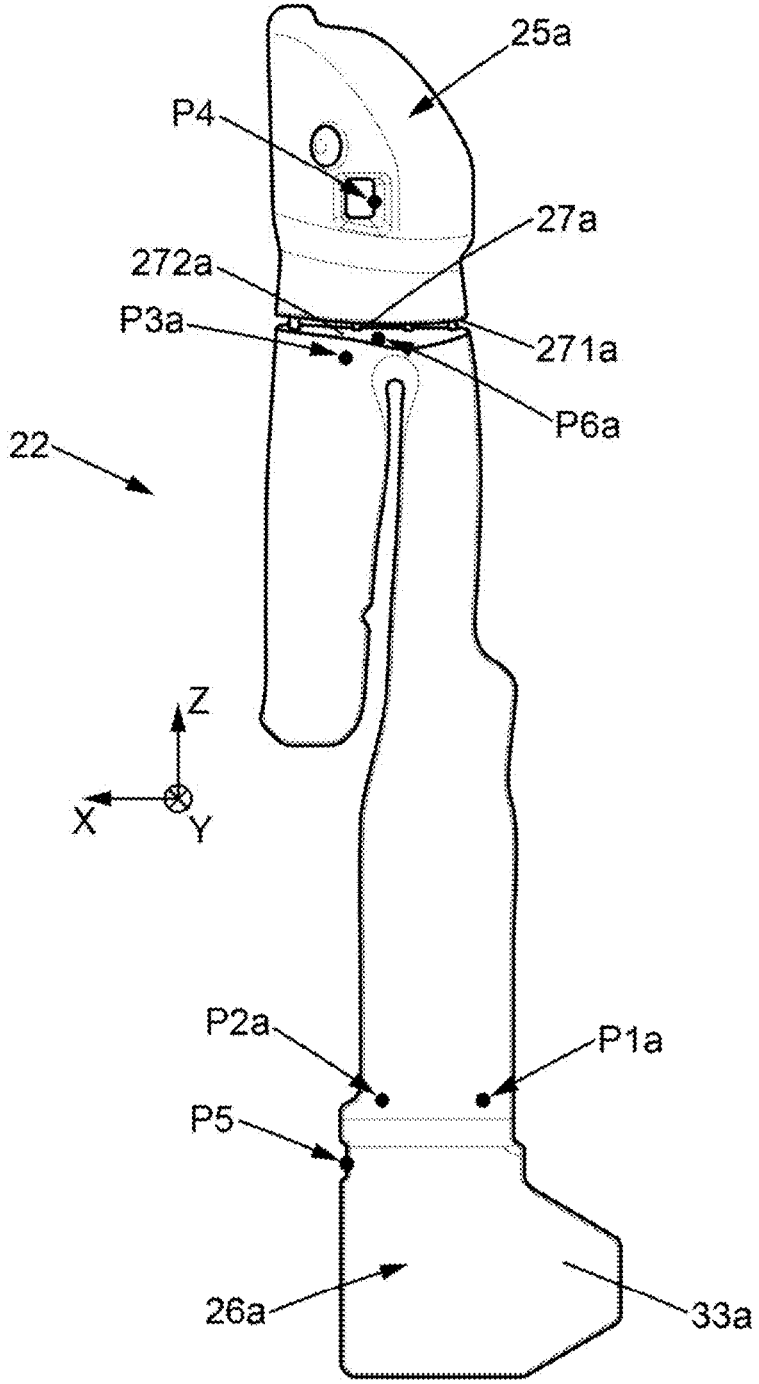
FIG. 3 shows a view of the leading core from its suction-side face, on which support points are schematically indicated.
Figure 4:
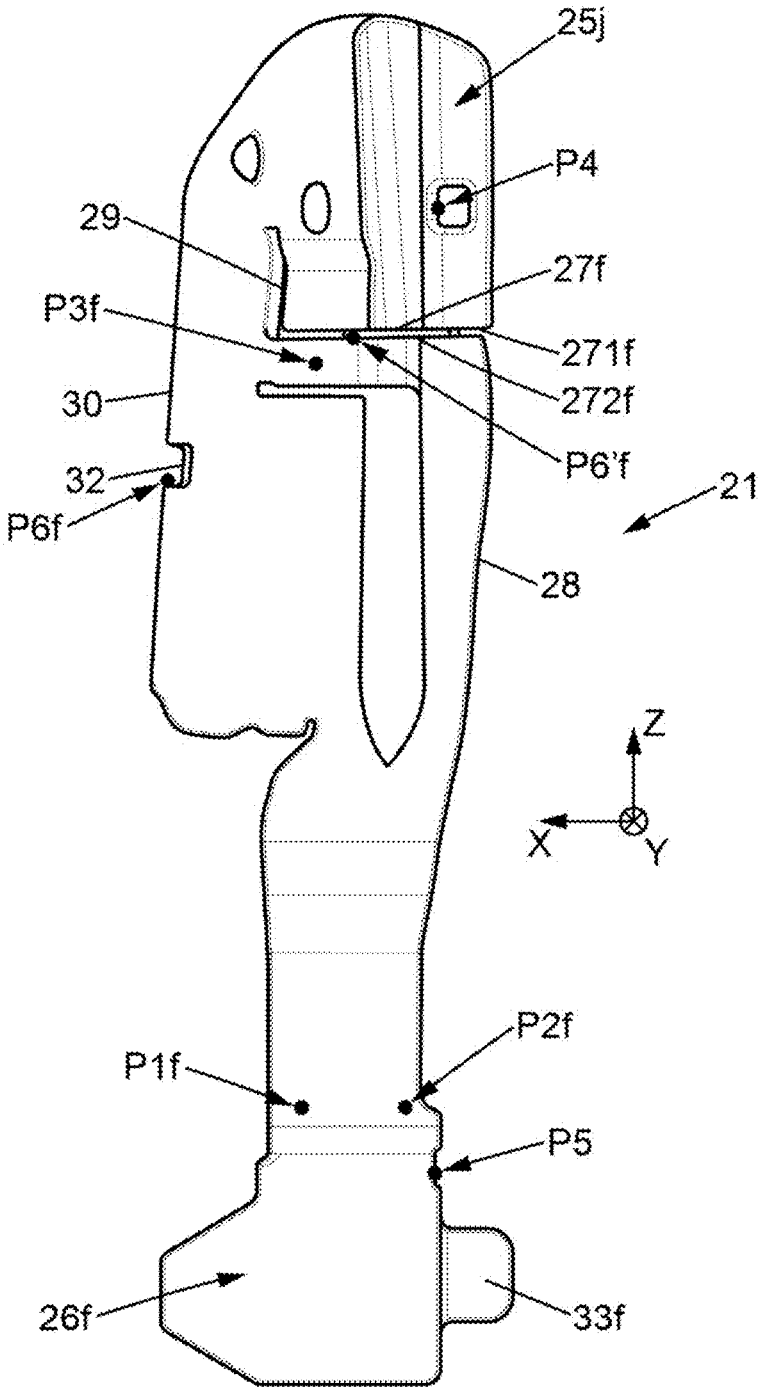
FIG. 4 shows a view of the trailing core from its suction-side face, on which support points are schematically indicated.

Paired core elements 21, 22 extend in three perpendicular directions, a first direction Z, hereinafter designated longitudinal direction Z corresponding in the final blade to the longitudinal direction connecting the root to the tip of the blade, a second direction Y, hereinafter designated transverse direction Y, passing through the pressure-side and suction-side faces of the blade, and a third direction X, hereinafter axial direction X, corresponding in the final blade to the upstream/downstream direction (arrow F). In FIG. 1, only the pressure-side face of leading core 23*a* and the pressure-side face of trailing core 23*f* are visible. The suction-side face of leading core 24*a* and the suction-side face of trailing core 24*f*, visible for each core in FIGS. 3 and 4, is arranged facing first molding face 20. Leading core element 22 and trailing core element 21 each comprise a head, respectively 25*a*, 25*f*, and a foot, respectively 26*a*, 26*f*, the head 25*a*, 25*f* being arranged at the opposite end from foot 26*a*, 26*f* along longitudinal direction Z. In the head area, each of the cores comprises a cutout 27*a*, 27*f*, meaning a portion with no material, which extends at least partially perpendicularly to longitudinal direction Z, along axial direction X. These cutouts also extend from pressure-side faces 23*a*, 23*f* towards suction-side faces 24*a*, 24*f*. These cutouts are intended to form a bottom wall of the squealer tip in the final blade. With reference to longitudinal direction Z and to FIG. 3, cutout 27*a* of leading core element 22 is delimited by an upper cutout wall 271*a* and a lower cutout wall 272*a*. Cutout 27*a* of the leading core extends over the entire width of the core, in axial direction X. With reference to longitudinal direction Z and to FIG. 4, cutout 27*f* of trailing core element 21 is delimited by an upper cutout wall 271*f* and a lower cutout wall 272*f*. Cutout 27*f* of trailing core extends over only part of the width of the core, along axial direction X. In particular, cutout 27*f* of trailing core extends from upstream edge 28 of the trailing core and ends in a longitudinal cutout portion 29 which extends longitudinally along longitudinal direction Z in the material of the core, and therefore without extending through the core to its downstream edge 30. Feet 26*a*, 26*f* further comprise a free end 31*a*, 31*f*, corresponding to a non-functional area of the core. Free ends 31*a*, 31*f* may at least partially overlap. For this purpose, free end 31*f* of the trailing core may comprise a tongue 33*f*. In addition, free end 31*a* of the leading core may comprise an indentation 33*a*. Indentation 33*a* is provided for receiving tongue 33*f*. The shapes are thus complementary between indentation 33*a* and tongue 33*f*. This overlap may allow hooking the two cores together in order to secure them to each other, for example by piercing the overlapping portion of material then inserting an aluminum rod.

Trailing core element 21 further comprises a notch 32 in its downstream edge 30. Notch 32 is arranged in the area of head 25*f*. Notch 32 is substantially U-shaped, oriented so that the opening of the U-shaped concavity is oriented along axial direction X.

Figure 2:
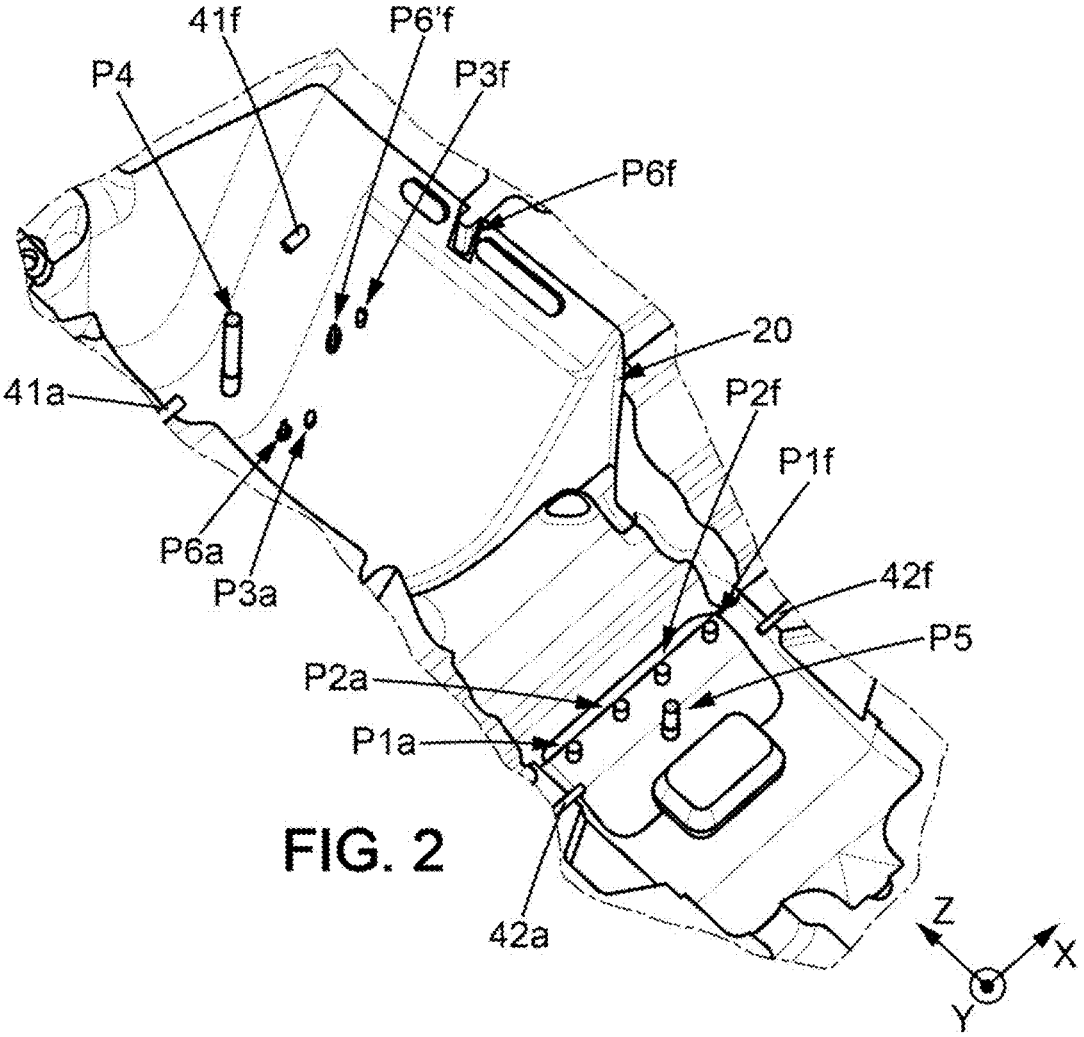
FIG. 2 shows the view of FIG. 1 but without the first and second core elements, the first face of the injection mold comprising retaining members with support points for holding the leading and trailing cores.

FIG. 2 illustrates first molding face 20, without any core elements 21, 22. First molding face comprises retaining members P1*a*, P1*f*, P2*a*, P2*f*, P3*a*, P3*f*, P4, P5, P6*a*, P6*f* for holding the cores in position in the injection mold. Each retaining member holds leading core element 22 or trailing core element 21 or both core elements 21,22 in position, in one of the three directions X, Y or Z. In particular, and as detailed below, leading core element 22 is placed in the injection mold by a first positioning frame of reference, and trailing core element 21 is placed in the injection mold by a second positioning frame of reference. The first positioning frame of reference is formed by retaining members P1*a*, P2*a*, P3*a*, P4, P5 and P6*a*. The second positioning reference frame is formed by retaining members P1*f*, P2*f*, P3*f*, P4, P5 and P6*f* (or alternatively a point P6*f*). As a result, the injection mold comprises two different frames of reference, each intended for a different core, retaining members P4 and P5 being retaining members common to the two cores.

In particular, retaining members P1*a*, P1*f*, P2*a*, P2*f*, P3*a* and P3*f* allow leading core 22 element or trailing core element 21 of both core elements 21, 22 to be held in position along transverse direction Y. Retaining members P1*a*, P2*a*, and P3*a* are provided for holding leading core element 22 in position along transverse direction Y. Retaining members P1*f*, P2*f*, and P3*f* are provided for holding trailing core element 21 in position along transverse direction Y. Each of retaining members P1*a*, P1*f*, P2*a*, P2*f*, P3*a* and P3*f* extends from first molding face 20, in transverse direction Y. Each of these members bears against one of the two cores, which prevents movement of the cores along transverse direction Y.

In particular, retaining members P1*a*, P2*a*, P2*f* and P1*f* are arranged in the area of foot 26*a*, 26*f* of the cores. Retaining members P1*a*, P2*a*, P2*f* and P1*f* are aligned along axial direction X. Retaining members P1*a*, P2*a*, P2*f* and P1*f* are arranged near the free end 31*a*, 31*f* of the cores. In other words, retaining members P1*a*, P2*a*, P2*f* and P1*f* are arranged outside the free end of the cores, but in the area of foot 26*a*, 26*f* of the cores. Retaining members P1*a*, P2*a*, P2*f* and P1*f* end in a support surface for the respective core, each of these support surfaces being substantially flat. In addition, each of these support surfaces is substantially perpendicular to transverse direction Y. These surfaces are located outside the functional area.

Retaining members P3*a* and P3*f* are arranged in the area of head 26*a*, 26*f* of the cores. Retaining member P3*a* and retaining member P3*f* are offset along longitudinal direction Z. In other words, retaining members P3*a* and P3*f* are not aligned along axial direction X. Retaining members P3*a* and P3*f* end in a support surface for the respective core, each of these support surfaces following the shape of the area of contact with the core. In other words, for optimal support, the support surfaces of retaining members P3*a* and P3*f* follow the shape of the surface of the core area with which they are in contact.

Additionally and alternatively, the second molding face may comprise retaining members similar to the retaining members described above, so as to lock the cores in position along transverse direction Y.

First molding face 20 may further comprise retaining members P6*a* and P6*f*. Retaining members P6*a* and P6*f* allow leading core element 22 or trailing core element 21 to be held in position along longitudinal direction Z, for example. Each of these members respectively bears against leading core element 22 and trailing core element 21, which prevents movement of the cores along longitudinal direction Z. Retaining member P6*a* is provided for example to retain leading core element 22 in position along longitudinal direction Z. Retaining member P6*a* extends from the first molding face, in transverse direction Y. Retaining member P6*a* bears against lower cutout wall 272*a* of leading core element 22. Retaining member P6*f* is provided, for example, for holding trailing core element 21 in position along longitudinal direction Z. Retaining member P6*f* extends from the first molding face, in axial direction X, in the downstream to upstream directional orientation. Retaining member P6*f* comes to rest in notch 32 of downstream edge 30 of trailing core element 21.

Alternatively, a retaining member P6'*f* may be provided instead of retaining member P6*f*. Retaining member P6'*f* is provided for holding trailing core element 21 in position along longitudinal direction Z. Retaining member P6'*f* extends from first molding face 20, in transverse direction Y. Retaining member P6'*f* bears against lower cutout wall 272*f* of trailing core element 21. In addition, retaining members P6*a* and P6'*f* are arranged so that the cutouts of the two cores are substantially aligned along axial direction X.

Only one of the two retaining members P6*f* and P6'*f* is used for the production of the wax molding, to position trailing core element 21 in longitudinal direction Z. Depending on the retaining member used, P6*f* or P6'*f*, the retaining member not in use is removed from the molding surface so as not to create a hyperstatic system. The choice of which point to use depends on the distribution of the desired expansion of the two cores during casting of the alloy.

In fact, retaining member P6 allows distributing the expansion of trailing core element 21 along longitudinal direction Z, towards head 25*f* and towards foot 26*f*, while avoiding too much of a difference in length compared to leading core element 22, particularly in the event of very different expansions between the two cores. On the other hand, retaining member P6'*f* is advantageously used to control the dimensions of a so-called "bottom" wall of a squealer tip present in the final blade. The bottom wall of the squealer tip is physically realized by cutouts 27*a*, 27*f* of the cores, which form a portion filled with material in the final blade. The bottom of the squealer tip is substantially planar, and extends in transverse direction Y and axial direction X. Due to the fact that the cores do not touch one another, meaning that they are not in contact, a portion of material referred to as a residual wall of the squealer tip bottom, separates the squealer tip bottom into two parts arranged at different levels along longitudinal direction Z. Residual wall 26 extends in longitudinal direction Z, from the bottom of squealer tip. The height of the residual wall, in longitudinal direction Z, is a characteristic which must be controlled in order to meet the aerodynamic performance of the blade. Indeed, it is desirable that the height of the residual wall be as low as possible, so as to avoid, to the extent possible, too significant of a difference in level between the portions of the squealer tip bottom. Consequently, retaining member P6'*f*, associated with retaining member P6*a*, places cutouts 27*a* and 27*f* in the same plane in the cores, which makes it possible to obtain two parts of the squealer tip bottom which are substantially in the same plane perpendicular to longitudinal direction Z.

The first molding face further comprises retaining members P4 and P5. Retaining members P4 and P5 allow leading core element 22 or trailing core element 21 or both core elements 21,22 to be held in position along axial direction X. Retaining members P4 and P5 are retaining members common to the two cores, leading core element 22 and trailing core element 21. To this end, retaining members P4 and P5 each comprise a first support point at which it bears against the leading core and a second support point at which it bears against the trailing core. Retaining members P4 and P5 together prevent rotation of the cores around transverse axis Y. Each of retaining members P4 and P5 extends from the first molding face, in transverse direction Y.

Figure 7:
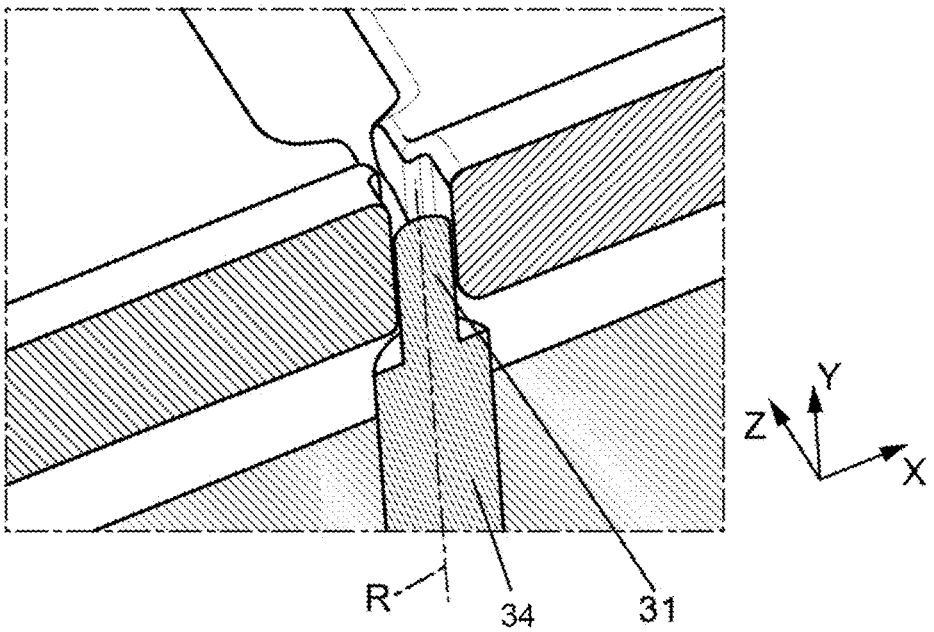
FIG. 7 is a section view of FIG. 1 along axis B-B, illustrating a first example embodiment of a retaining member.
Figure 8:
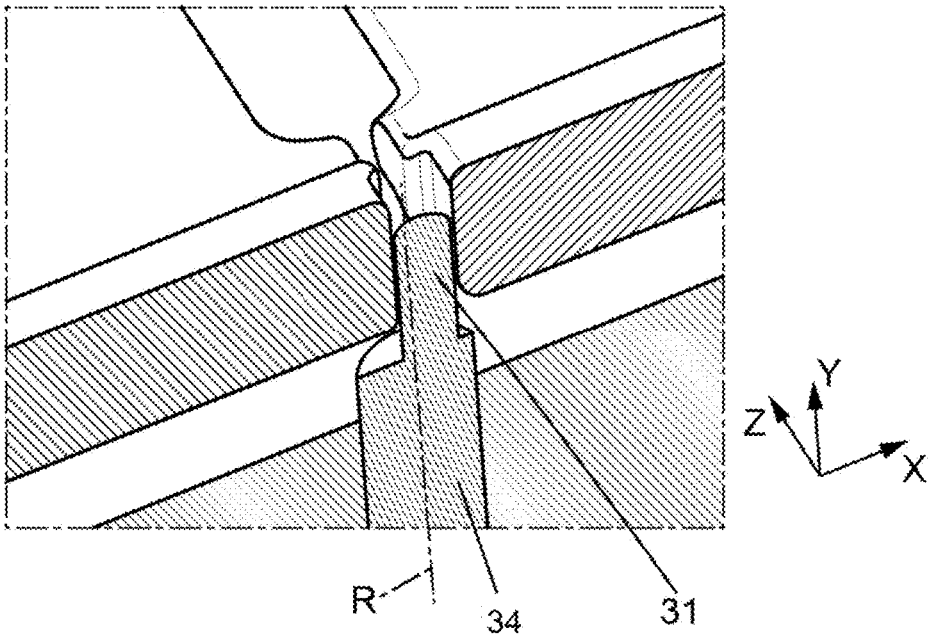
FIG. 8 is a section view of FIG. 1 along axis B-B, illustrating a second example embodiment of a retaining member.
Figure 9:
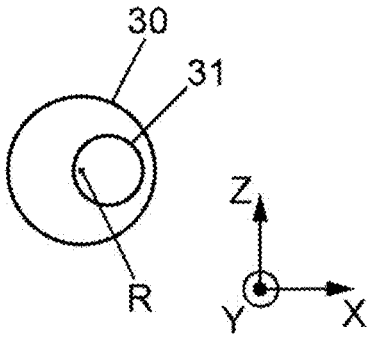
FIG. 9 is a top view of the example shown in FIG. 8.

FIGS. 7, 8 illustrate example embodiments of a retaining member, in a section view in axial direction X. FIG. 9 is a top view of the example in FIG. 8. These example embodiments may apply for example to either of retaining members P4, P5 or to both retaining members P4 and P5. In these examples, the retaining member comprises a base 34 and a head 31. Base 34 is cylindrical. Base 34 is further arranged in the mold, and can pivot around its axis of rotation R which is coincident with its axis of revolution. Head 31 is a rod which extends in transverse direction Y, from base 34. In the example illustrated in FIG. 7, head 31 is aligned with the axis of rotation R. Consequently, the rotation of base 34 of the retaining member around the axis of rotation R does not cause any offset of head 31, i.e. no translational movement within the plane defined by the transverse Y and longitudinal Z directions. In the example illustrated in FIGS. 8 and 9, head 31 is eccentric relative to base 34. In other words, head 31 is not aligned with the axis of rotation R of base 34. Consequently, head 31 has, in this example, an eccentric function: head 31 moves in a plane defined by the transverse Y and longitudinal Z directions. This example advantageously makes it possible to move leading core element 22 and trailing core element 21, in order to adjust their position in the mold, leading core element 22 and trailing core element 21 cooperating with the retaining member as detailed further below in the description.

Retaining member P4 (or first retaining member) may be arranged in the area of head 25*a*, 25*f*. Retaining member P5 (or second retaining member) may be arranged in the area of foot 26*a*, 26*f* at the connection to free end 31*a*, 31*f*. Retaining members P4 and P5 may further be aligned in longitudinal direction Z. Retaining members P4 and P5 are arranged in a non-functional zone, meaning external to the part.

Figure 5:
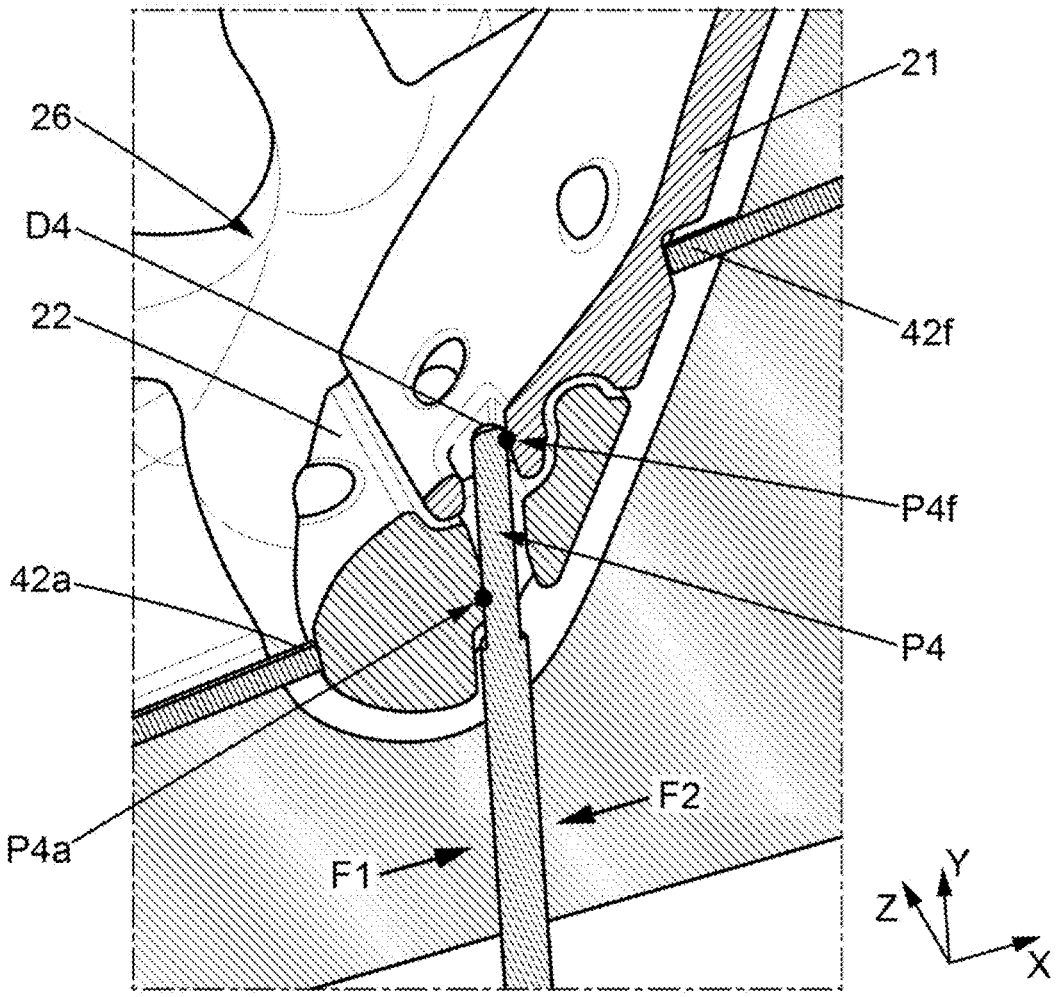
FIG. 5 is a section view of FIG. 1 along axis A-A.

Retaining member P4 can be seen in FIG. 5, corresponding to a section view along axis A-A of FIG. 1. One can see that retaining member P4 comprises a first support point at which it bears against leading core P4*a*, and a second support point at which it bears against trailing core P4*f*. First support point P4*a* blocks movement of leading core element 22 from upstream to downstream in direction F1. Also, second support point P4*f* blocks movement of the trailing core from downstream to upstream in direction F2, meaning a direction that is opposite to the direction in which the leading core is blocked. Retaining member P4 may further be a through-member. Through-member is understood to mean that retaining member P4 extends from first molding face 20 to pressure-side face 23*f* of trailing core, respectively passing through the suction-side face of leading core 24*a*, the pressure-side face of leading core 23*a*, and the suction-side face of trailing core 24*f*.

Figure 6:
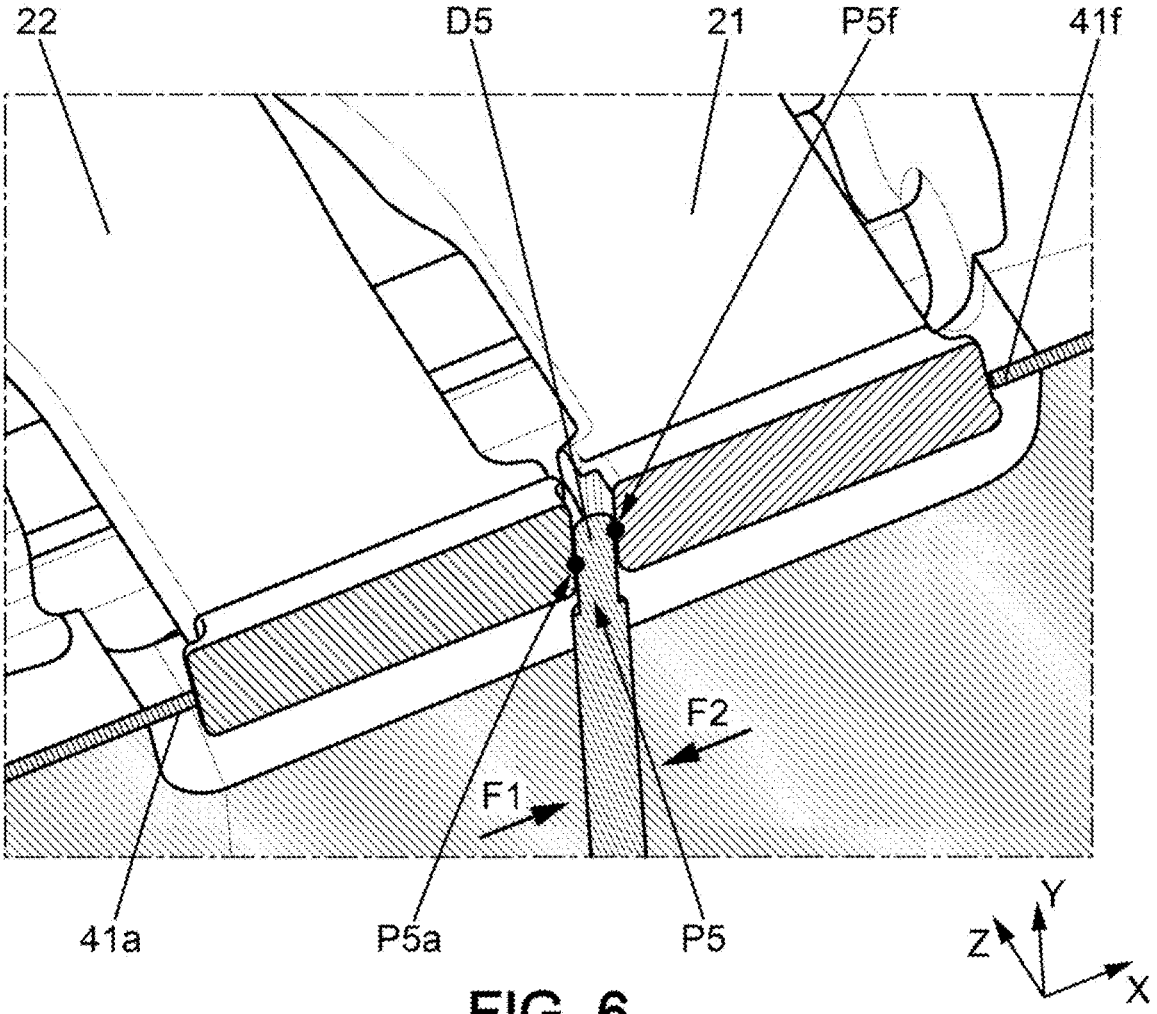
FIG. 6 is a section view of FIG. 1 along axis B-B.

Retaining member P5 can be seen in FIG. 6, corresponding to a section view along axis B-B of FIG. 1. One can see that retaining member P5 comprises a first support point at which it bears against leading core P5*a*, and a second support point at which it bears against trailing core P5*f*. The first support point of retaining member P5*a* blocks movement of leading core element 22 from upstream to downstream in direction F1. Also, the second support point of retaining member P5*f* blocks movement of trailing core element 21 in direction F2 from downstream to upstream, meaning in a direction that is opposite to the direction F1 in which the leading core is blocked. Retaining member P5 may further be a through-member. Through-member is understood to mean that retaining member P5 extends from first molding face 20 towards pressure-side face 23*a*, 23*f* of the trailing core and leading core, and beyond suction-side face 24*a*, 24*f* of the cores, in transverse direction Y. However, as can be seen in FIG. 6, in transverse direction Y, retaining member P5 only extends through an alignment defined by suction-side faces 24*a*, 24*f* of the two cores, without extending through the cores. In other words, retaining member P5 is arranged between the two cores, and extends beyond their suction-side face 24*a*, 24*f* but without extending beyond their pressure-side face 23*a*, 23*f*. Alternatively, retaining member P5 may extend beyond their pressure-side face 23*a*, 23*f*.

In addition, retaining member P4 and/or retaining member P5 may be movable between a retaining position and a retracted position. In the retaining position, visible in FIGS.

4 and 5, which may also be called the deployed position, the retaining member is in contact with at least one of the cores. In the retracted position, the retaining member is withdrawn relative to the cores, its length being less than its length in the retaining position. The mobility of the retaining member(s) makes it easy to unmold the obtained part. Indeed, when the retaining member, in its deployed position, is arranged along an axis different from the demolding axis, its retracted position allows the retaining member not to oppose the demolding. The retaining member further comprises a retraction mechanism, ensuring mobility between the retracted position and the retaining position.

Alternatively, retaining member P4 and/or retaining member P5 may further comprise a spacing means D4, D5 between their first and second support points. The spacing means ensures a separation (or spacing) of a constant distance between the first and second support points, the separation distance being measured for example in axial direction X. More precisely, spacing means D4, D5 keeps the two cores spaced apart from each other without them being in contact, meaning without the cores touching each other. Given that the cores extend in the three spatial directions, the separation distance may be measured in longitudinal direction Z or in transverse direction Y. A spacing means is for example physically realized by the diameter of the retaining member. The retaining member may for example have a constant diameter along its entire length. According to another example, the retaining member may have a smaller diameter towards its free end, and a larger diameter towards its base (meaning towards the first molding face).

Alternatively, retaining member P4 and/or retaining member P5 may further comprise adjustment means for adjusting the position of the cores in the first molding face. For example, the adjustment means is an eccentric, which may be rotated around transverse direction Y in order to shift the two cores in the plane formed by the transverse and axial directions.

In another alternative, first molding face 20 may further comprise counter-braces, as illustrated in FIG. 2. One can thus see that first molding face 20 comprises, for leading core element 22, a first counter-brace 41*a* and a second counter-brace 42*a*. For trailing core element 21, first molding face 20 also comprises a first counter-brace 41*f* and a second counter-brace 42*f*. The counter-braces help retain the cores in the mold, as well as maintaining contact of the cores with the support points. For example, as can be seen in FIG. 6, first counter-brace 41*a* of leading core element 22 presses the leading core against retaining member P4. In addition, first counter-brace 41*f* of trailing core element 21 presses trailing core element 21 against retaining member P4. Also, as can be seen in FIG. 5, second counter-brace 42*a* of leading core element 22 presses the leading core against retaining member P5. In addition, first counter-brace 41*f* of trailing core element 21 presses trailing core element 21 against retaining member P5. As also can be seen in FIGS. 5 and 6, first counter-braces 41*a*, 41*f* and second counter-braces 42*a*, 42*f* respectively extend in axial direction X. Furthermore, first counter-braces 41*a*, 41*f* and second counter-braces 42*a*, 42*f* may be aligned along axial direction X with respective retaining members P4 and P5.

Alternatively, although not illustrated, the elements described above for retaining member P4 may be applied to retaining member P5, and conversely the elements described above for retaining member P5 may be applied to retaining member P4. For this purpose, the first retaining member may be retaining member P5 and the second retaining member may be retaining member P4. Thus, the first support point and the second support point of first retaining member P5 may respectively be points P5*a* and P5*f*, and the first support point and the second support point of second retaining member P4 may respectively be points P4*a* and P4*f*.

We now describe a method for producing a molding, made of removable material, of a turbomachine blade, the method comprising:

providing leading core element 22 and trailing core element 21;

providing the injection mold for the removable material;

positioning leading core element 22 and trailing core element 21 on first molding face 20. In this position, the first retaining member has a first support point at which it bears against a first support surface of a core element, the first bearing surface extending against the core in order to hold the core element in position along the second direction. Furthermore, in this position, retaining member(s) P4, P5 at least partially extend(s) into leading core 22 element and trailing core element 21.

Alternatively, the method may comprise: closing the mold while positioning on the core elements the second molding face, with at least one complementary retaining member.

The invention claimed is:

1. An assembly for producing a molding, made of removable material, of a turbomachine blade, comprising an injection mold for said removable material in which a first core element and a second core element are configured to be mounted in a predetermined molding position, the first and second core elements extending in a first direction, the mold comprising:

a first molding face configured to mold a pressure-side face of the blade and a second molding face configured to mold a suction-side face of the blade and arranged facing the first face in a second direction perpendicular to the first direction, and retaining members configured to hold the cores in position in the injection mold, wherein at least a first retaining member extends from the first face of the mold in the second direction and extends at least partially through the first and second core elements, the first retaining member comprising a first support point at which the first retaining member bears against the first core element and a second support point at which the first retaining member bears against the second core element.

2. The assembly according to claim 1, wherein the first core element and the second core element are shaped so that the first support point of the first retaining member blocks movement of the first core element in a first directional orientation along a third direction perpendicular to the first and second directions, and the second support point of the first retaining member blocks movement of the second core element in a second directional orientation that is opposite to the first directional orientation along the third direction.

3. The assembly according to claim 1, wherein a second retaining member extends from the first molding face in the second direction, the second retaining member comprising a first support point at which the second retaining member bears against the first core element and a second support point at which the second retaining member bears against the second core element, said first support point and second point of support of the second retaining member being different from the first support point and the second support point of the first retaining member.

4. The assembly according to claim 3, wherein the first core element and the second core element are shaped so that the first support point of the second retaining member blocks movement of the first core element in the first directional orientation along a third direction perpendicular to the first and second directions and the second support point of the second retaining member blocks movement of the second core element in a second directional orientation that is opposite to the first directional orientation along the third direction.

5. The assembly according to claim 4, wherein the second retaining member comprises a spacing means between the first support point of the second retaining member and the second support point of the second retaining member, the spacing means ensuring, during production of the molding made of removable material, a spacing of a constant distance between said support points along the third direction.

6. The assembly according to claim 1, wherein the first retaining member comprises a spacing means between the first support point of the first retaining member and the second support point of the first retaining member, the spacing means ensuring, during production of the molding made of removable material, a spacing of constant distance between said support points along at least one among the first direction, the second direction, or the third direction.

7. The assembly according to claim 1, wherein the first retaining member and/or the second retaining member is movable between a retaining position, in which the second retaining member holds at least one core element, and a retracted position, the retaining member comprising a retraction mechanism configured to position the retaining member in the retaining position or in the retracted position.

8. The assembly according to claim 1, wherein the first retaining member and/or the second retaining member comprises an axis of rotation and a head that is eccentric relative to the axis of rotation and that cooperates with the first core element and the second core element.

9. A method for producing a molding, made of removable material, of a turbomachine blade, the method comprising:

providing a first core element and a second core element, said core elements extending in a first direction; and providing an injection mold for said removable material, wherein the mold comprises:

a first molding face configured to mold a pressure-side face of the blade and a second molding face configured to mold a suction-side face of the blade and arranged facing the first face in a second direction perpendicular to the first direction; and retaining members configured to hold the cores in position in the injection mold, among which at least a first retaining member extends from the first molding face in the second direction, the method further comprising the step of positioning the first core element and the second core element on the first molding face such that the first retaining member extends at least partially through the first and second core elements and comprises a first support point at which the first retaining member bears against the first core element and a second support point at which the first retaining member bears against the second core element.

10. The method according to claim 9, the mold further comprising a second retaining member extending from the first molding face in the second direction, the method further comprising the step of positioning the first core element and the second core element on the first molding face such that the second retaining member comprises a first support point at which the second retaining member bears against the first core element and a second support point at which the second retaining member bears against the second core element.

* * * * *